US009366112B2

(12) United States Patent
Breithaupt

(10) Patent No.: US 9,366,112 B2
(45) Date of Patent: Jun. 14, 2016

(54) SUBSEA PRODUCTION COOLER WITH GAS LIFT

(71) Applicant: Shell Oil Company, Houston, TX (US)

(72) Inventor: Truman Adalbert Breithaupt, Metairie, LA (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 14/692,153

(22) Filed: Apr. 21, 2015

(65) Prior Publication Data

US 2015/0308230 A1 Oct. 29, 2015

Related U.S. Application Data

(60) Provisional application No. 61/983,254, filed on Apr. 23, 2014.

(51) Int. Cl.

| | |
|---|---|
| ***E21B 36/00*** | (2006.01) |
| ***E21B 43/01*** | (2006.01) |
| ***E21B 43/36*** | (2006.01) |

(52) U.S. Cl.

CPC ..... *E21B 36/001* (2013.01); *E21B 43/36* (2013.01)

(58) Field of Classification Search

CPC ..... E21B 36/001; E21B 43/01; E21B 36/00

USPC ..... 166/344, 351, 357, 368, 302, 369, 166/75.12

See application file for complete search history.

(56) References Cited

U.S. PATENT DOCUMENTS

| | | | | |
|---|---|---|---|---|
| 2,591,879 A * | 4/1952 | Russell | E21B 36/00 261/158 |
| 2010/0252227 A1* | 10/2010 | Sten-Halvorsen | E21B 36/001 165/45 |
| 2012/0168142 A1* | 7/2012 | Hernandez | E21B 36/001 165/279 |

FOREIGN PATENT DOCUMENTS

| | | | |
|---|---|---|---|
| NO | WO 2013004276 A1 * | 1/2013 | F28D 1/022 |
| NO | WO 2015026237 A1 * | 2/2015 | F28G 1/00 |

* cited by examiner

*Primary Examiner* — James G Sayre

(57) ABSTRACT

A subsea production cooler module comprising: coiled tubing, wherein the coiled tubing comprises an inlet and an outlet; and gas lift injector positioned above the coiled tubing.

7 Claims, 5 Drawing Sheets

SUBSEA PRODUCTION COOLER WITH GAS LIFT

CROSS-REFERENCE TO RELATED APPLICATIONS

This application claims the benefit of U.S. Provisional Application No. 61/983,254, filed Apr. 23, 2014, the entirety of which is incorporated herein by reference.

BACKGROUND

The present disclosure relates generally to subsea production coolers. More specifically, in certain embodiments the present disclosure relates to subsea production coolers that utilize natural convection and gas lift and associated methods.

Crude oil and other fluids produced from production wells are sometimes produced at temperatures too high for handling by available subsea hardware, for example at temperatures at or above 400° F. These high temperatures may create a thermal strain on hardware on the seafloor and often may require additional cooling of the fluid on the topsides. As a result, it is desirable to cool these fluids to temperatures in the range of 180° F. to 300° F. before they are transported along or from the seafloor.

Conventional subsea cooling techniques utilize un-insulated production piping arranged in sets of hairpin turns or other configurations such as a pyramid convecting freely to the surroundings. Typically, these conventional subsea cooling techniques have very limited ability to adapt to changing flow rates or temperatures of the produced fluids. This may result in excessive cooling, which may be problematic in fluids that are not fully inhibited against hydrate blockage by chemicals.

One type of subsea cooler utilizes coiled tubing surrounded by a shroud to provide a passive cooling system. An example of such a cooler is described in U.S. Patent Application 61/831,880, the entirety of which is hereby incorporated by reference. However, it may be desirable to provide a subsea cooler comprising coiled tubing surrounded by a shroud that is not a completely passive system.

SUMMARY

The present disclosure relates generally to subsea production coolers. More specifically, in certain embodiments the present disclosure relates to subsea production coolers that utilize natural convection and gas lift and associated methods.

In one embodiment, the present disclosure provides a subsea production cooler module comprising: coiled tubing, wherein the coiled tubing comprises an inlet and an outlet; and gas lift injector positioned above the coiled tubing.

In another embodiment, the present disclosure provides a subsea production cooler comprising: a subsea production cooler module comprising: coiled tubing, wherein the coiled tubing comprises an inlet and an outlet; and gas lift injector positioned above the coiled tubing; a base; and a piping system.

In another embodiment, the present disclosure provides a method of cooling a subsea production stream comprising: providing a subsea production stream and cooling the subsea production stream with a subsea production cooler module, wherein the subsea production cooler module comprises: coiled tubing, wherein the coiled tubing comprises an inlet and an outlet; and gas lift injector positioned above the coiled tubing.

BRIEF DESCRIPTION OF THE DRAWINGS

A more complete and thorough understanding of the present embodiments and advantages thereof may be acquired by referring to the following description taken in conjunction with the accompanying drawings.

Figure 1A:
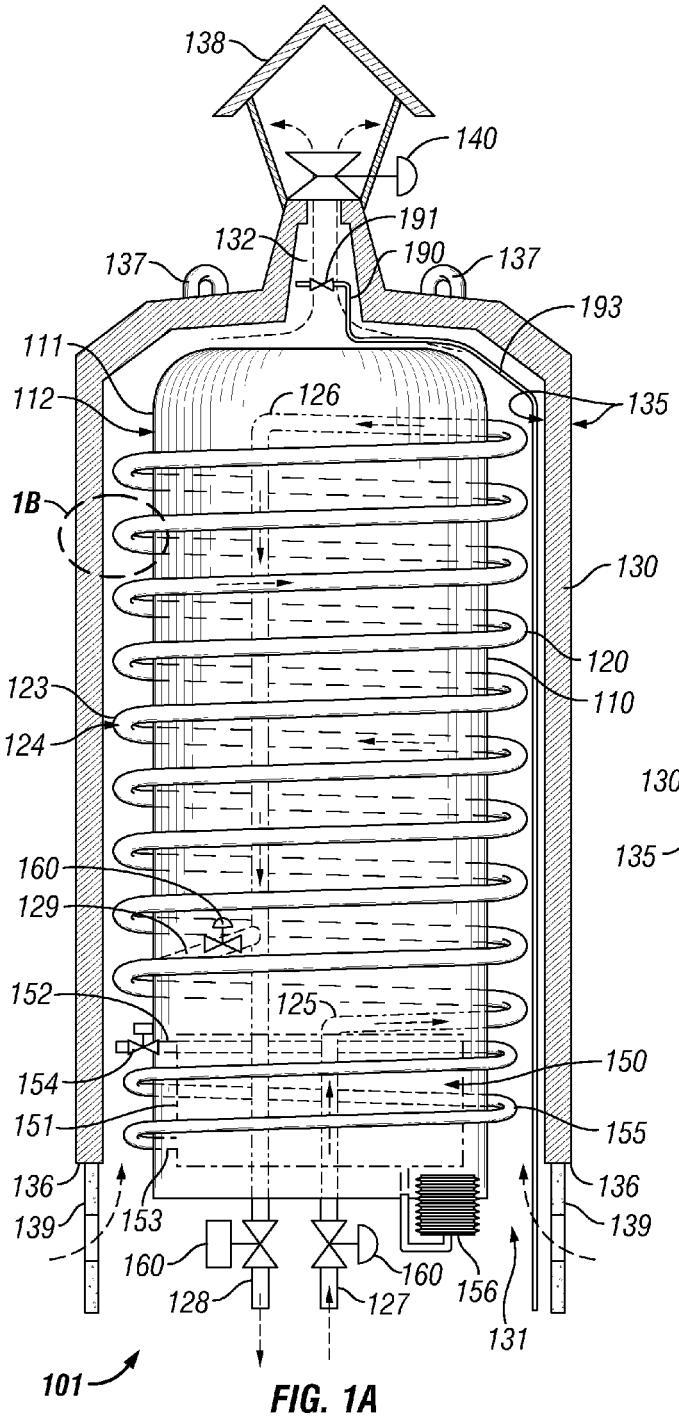
FIGS. 1A and 1B are illustrations of a subsea production cooler module in accordance with certain embodiments of the present disclosure.

The features and advantages of the present disclosure will be readily apparent to those skilled in the art. While numerous changes may be made by those skilled in the art, such changes are within the spirit of the disclosure.

DETAILED DESCRIPTION

The description that follows includes exemplary apparatuses, methods, techniques, and/or instruction sequences that embody techniques of the inventive subject matter. However, it is understood that the described embodiments may be practiced without these specific details.

In certain embodiments, the present disclosure relates to techniques for cooling production fluids produced from subsea wells. Such cooling may involve utilizing natural convection and/or a gas lift. In certain embodiments, the cooling may be accomplished without using pumps to circulate the production fluids or cooling fluid within the subsea production coolers.

Produced fluid exiting a wellhead on an ocean floor may flow through a series of coils in a production cooler where it is cooled by cold sea water or other cooling fluid. The cold sea water or other cooling fluid may be heated by the coils, become less dense, and rise away from the coils due to natural convection. A gas lift located above the series of coil may also provide a gas lift to increase the flow of fluid. As the heated sea water or other cooling fluid rises away it may be replaced by colder, denser seawater from the surrounding area in a continuous flow or by cooled cooling fluid. Because the flow of the produced fluid through the coils may be due to well pressure and the flow of seawater or other cooling fluid may be driven by buoyancy and gas lift, in certain embodiments the pumping of fluids is not be required.

Some desirable attributes of the subsea production coolers discussed herein may include: predictable performance for both design and operational monitoring; the ability to adjust heat transfer to maintain desired outlet temperature; the ability to tolerate changes in production flow rate and maintain desired outlet temperature; a cool down time similar to the insulated flowline system; robust piping capable of withstanding multiphase flow; functionality to distribute multiphase flow and produce even cooling; by-passable; minimization of both internal and external fouling; the ability to maintain interior wall temperature greater than the wax deposition temperature (e.g. 110° F. at all times); the ability to maintain exterior wall temperature less than the seawater scale formation temperature (e.g. 130° F. at all times); the ability to allow sea water side cleaning by remotely operated vehicles, and the ability to control circulation of the sea water to meeting cooling demand.

A particular advantage of the subsea production cooler discussed herein is that it has the ability to drive the cooling medium more directly via a gas lift arrangement using air supplied from the topsides facility than a passive cooler system. It also offers a solution to drive the cooling medium across the tube bundle offering higher efficiency and controllability. In addition, each of the components of the subsea coolers described herein may be recoverable allowing for the subsea cooler to be cleaned when not in operation.

Figure 1B:
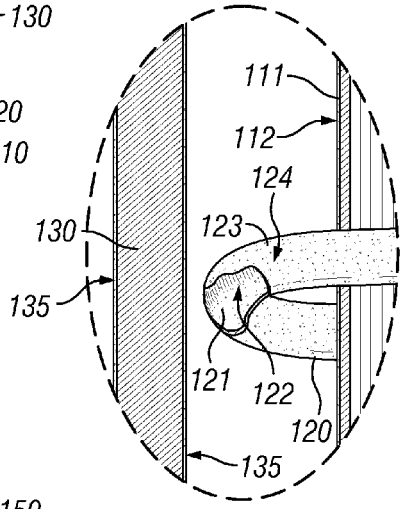

Referring now to FIG. 1, FIG. 1 illustrates a subsea production cooler module 101 in accordance with certain embodiments of the present disclosure. In certain embodiments, subsea production cooler module 101 may comprise coiled tubing 120 and gas lift injector 190.

In certain embodiments, coiled tubing 120 may comprise any suitable tubing material in a coil formation. In certain embodiments, coiled tubing 120 may comprise a single coil of tubing or multiple coils of tubing. For example, coiled tubing 120 may comprise one, two, three, four, or five or more individual coils of tubing. In certain embodiments, each individual coil of tubing may have its own inlet and outlet. In certain embodiments, coiled tubing 120 may define a cavity. In other embodiments, when subsea cooler 100 comprises a core, coiled tubing 120 may be coiled around the core.

In certain embodiments, coiled tubing 120 may have a coil geometry comprising one or more inner coils and one or more outer coils. In certain embodiments, the one or more outer coils may be disposed around the one or more inner coils. In certain embodiments, the inner and outer coils may be spiraled in the same direction. In other embodiments, the inner and outer coils may be spiraled in opposite directions. In embodiments where the inner and outer coils are spiraled in opposite directions, torsion present in the inner and out outer coil in coiled tubing 120 may be arranged to balance each other, which may in turn decrease the overall structural strength required to manage the force and movement of coiled tubing 120 under production pressures and temperatures.

In certain embodiments, the geometry of coiled tubing 120 may maximize the beneficial effect of creating flow through two independent, but complimentary effects. First, by having multiple individual coils of tubing transferring heat to the same fluid multiplies the temperature rise and the subsequent coolant buoyancy that creates the natural convection heat transfer. Second, by placing the coils in close proximity to each other (or any other surface), there may be an additional enhancement of heat transfer at certain operating conditions due to fluid flow effects. For example, in certain embodiments, the coils may be spaced such that the distance between the center of coiled tubing 120 in each coil is from 1.5 to 2 times the diameter of coiled tubing 120.

In certain embodiments, the geometry of coiled tubing 120 may allow the avoidance of sudden turns that occur in standard elbows or hairpin turns, reducing the localized accumulation of solids on the interior wall of coiled tubing 120 through enhanced deposition that is believed to be due to low velocity areas created in the fluid stream by the turning actions and the cold spots that can occur due to the non-uniform flow field.

Coiled tubing 120 may be constructed out of any suitable tubing material. Examples of suitable tubing materials comprise carbon steel, stainless steel, titanium, nickel alloys, and composite materials. In certain embodiments, the composite materials may comprise different materials arranged to give certain beneficial properties to the surfaces of the coil 120 that may be different than the properties of the bulk of the tube wall. In certain embodiments, coiled tubing 120 may comprise an inner diameter of from one inch to six inches.

In certain embodiments, an inner surface 121 of coiled tubing 120 may comprise an inner coating 122. Inner surface 121 may be completely or partially coated with inner coating 122. In certain embodiments, inner coating 122 may comprise ceramic enamel or a diamond-like coating. In certain embodiments, inner coating 122 may be from 2 to 30 microns thick. In other embodiments, inner coating 122 may be from 5 to 10 microns thick.

In certain embodiments, an outer surface 123 of coiled tubing 120 may comprise an outer coating 124. Outer surface 123 may be completely or partially coated with outer coating 124. In certain embodiments, outer coating 124 may comprise ceramic enamel, ethylene copolymer such as Halar, a thermoset polymer, a diamond-like coating, or a phenolic coating. In certain embodiments, outer 124 coating may be from 2 microns thick to 400 microns thick. In other embodiments, outer coating 124 may be from 10 microns thick to 50 microns thick.

The selection of material and thickness for coiling tubing 120 may be critical in controlling the surface temperatures both on the inside and the outside of coiled tubing 120. In certain embodiments, it may be desirable to keep the coil surface temperatures in safe limits by designing the appropriate fluid velocities and heat transfer coefficients. In certain embodiments, the temperature of inner surface 121 or inner coating 122 of coiled tubing 120, as appropriate, should be maintained above a minimum value because of the concern of wax deposits. In certain embodiments, the temperature of inner surface 121 or inner coating 122 of coiled tubing 120 should be maintained at a temperature greater than 110° F. In certain embodiments, the temperature of outer surface 123 or outer coating 124 of coiled tubing 120, as appropriate, should be maintained below a maximum value because of concerns with corrosion and sea water scaling. In certain embodiments, the temperature of outer surface 123 or outer coating 124 of coiled tubing 120, as appropriate, should be maintained at a temperature less than 150° F. In other embodiments, the temperature of outer surface 123 or outer coating 124 of coiled tubing 120, as appropriate, should be maintained at a temperature less than 130° F.

In certain embodiments, coiled tubing 120 may comprise an inlet 125 and an outlet 126. In certain embodiments, inlet 125 may be located near the bottom of coiled tubing 120 and outlet 126 may be located near the top of coiled tubing 120. Inlet 125 may be connected to a hot production fluid line 127. Outlet 126 may be connected to a vertical discharge line 128. In other embodiments, hot production fluid line 127 and/or vertical discharge line 128 may be disposed within the cavity defined by coiled tubing 120. In certain embodiments, for example when subsea cooler 100 comprises a core, hot production fluid line 127 and/or vertical discharge line 128 may disposed within a hollow center of the core or disposed on an outside surface 111 of the core.

In certain embodiments, coiled tubing 120 may comprise one or more bypass lines 129 allowing the fluid to short circuit the production fluid path to the outlet 126, and allow production fluid to flow into the vertical discharge line 128. In certain embodiments, bypass line 129 may have a valve 160 installed to manage the volume of flow directed through bypass line 129.

In certain embodiments, gas lift injector 190 may be positioned above coiled tubing 120. In certain embodiments, gas lift injector 190 may be a stand pipe. In certain embodiments, gas lift injector 190 may comprise a gas lift injection valve 191. In certain embodiments, gas lift injector 190 may be connected to a feed line 193 connected to a topsides compressor (not illustrated). In certain embodiments, the feed line 193 may be an umbilical tube or a separate delivery line. In certain embodiments, not illustrated, feed line 193 may be disposed within a cavity formed by coiled tubing 120. In certain embodiments, not illustrated, feed line 193 may be disposed within core 110. In other embodiments, feed line 193 may be disposed outside of coiled tubing 120 within shroud 130.

In certain embodiments, the use of gas lift injector 190 may provide gas lift to subsea cooler module 101. The gas lift may function similarly to gas lift in wells. Air injected above the coils may act to increase the upward flow of the cooling water via both a density difference and an increase in gas volume as it rises offering acceleration.

During operation, a production fluid may flow into the subsea production cooler module 101 through hot production fluid line 127, through the coiled tubing 120 where it is cooled, and out of the subsea production cooler module 101 through vertical discharge line 128. The flowrate of the production fluid entering the subsea production cooler module 101 may be determined by the particular production well supplying the production fluid to subsea production cooler module 101. This flowrate may vary considerably, particularly during conditions when the production well is brought back online after being shut off.

The production rates that the subsea production cooler module 101 may efficiently cool to desired outlet temperatures may be in the range from 2000 barrels/day to 50,000 barrels/day. Any number of combinations of flowrate, pressure, temperature, fluid thermodynamic state, and compositional details may exist at the inlet 125 and outlet 126 of subsea production cooler module 101. This possible variation of many operating parameters is well known to those skilled in the art. In certain embodiments, the production fluid entering the subsea production cooler may be at a temperature of from 250° F. to 450° F. In certain embodiments, production fluid leaving the subsea production cooler module may at a temperature of from 150° F. to 250° F.

In certain embodiments, the production fluid may flow upward through the coiled tubing 120 while it is cooled. Although this upward flow may be atypical, it is believed that this upward flow may be advantageous, particularly when the production fluid is a multiphase fluid. By directing the flow upward, a multiphase flow regime will tend towards slugging flow, which will continually move the gas along and intermittently wet inner surface 121 of coiled tubing 120. This may help eliminate cold spots on inner surface 121 of coiled tubing 120 which could become nucleation sites for solid deposits such as paraffins. Also, the inner surface of coiled tubing 120 may warmed by the liquid flow allowing for a more uniform and efficient heat transfer. One or more valves 160 may regulate the flow of production fluids through the hot production fluid line 127 and the vertical discharge line 128.

In certain embodiments, subsea production cooler module 101 may further comprise a core 110. In certain embodiments, core 110 may generally have a cylindrical shape. Core 110 may be sized to efficiently cool a variety of production temperatures and flow rates. In certain embodiments, core 110 may be from 3 feet to 15 feet in diameter and/or from 10 feet to about 100 feet in height. Core 110 may be constructed out of any material suitable for in a deepwater environment. Examples of suitable materials include steel, glass reinforced plastic, and/or a variety of composite materials. In certain embodiments, gas line 193 may pass through core 110 for heating.

In certain embodiments, an outside surface 111 of core 110 may comprise a coating 112. Examples of suitable coating materials include solid glass reinforced plastics, epoxy coatings, specialized paints, and insulating materials. Coating 112 may be structural, semi-structural, or non-structural in order to achieve a desired shape, geometry, or surface characteristic. In certain embodiments, the thickness of coating 112 may be determined by its desired properties. In certain embodiments, coating 112 may be from about 0.005 inches thick to 0.020 inches thick. In other embodiments, coating 112 may be from about from 0.1 inches thick to 0.4 inches thick. In other embodiments, coating 112 may be from 0.02 inches thick to 0.05 inches thick. In certain embodiments, coating 112 may prevent the warmed cooling fluid retained in subsea production cooler module 101 from rapidly cooling during unexpected shutdowns. In certain embodiments, core 110 may have a hollow center. In other embodiments, the subsea production cooler module 101 may have no core.

In certain embodiments, subsea production cooler module 101 may further comprise a shroud 130. In certain embodiments, shroud 130 may be disposed around core 110 and coiled tubing 120. In certain embodiments, shroud 130 may be a hollow structure with generally cylindrical shape. In certain embodiments, shroud 130 may encase gas lift injector 190 and gas lift injection valve 191. In certain embodiments, gas lift injection valve 191 may be located above shroud 130. In certain embodiments, gas feed line 193 and/or gas lift injector 190 may pass through outlet 132 of shroud 130.

Shroud 130 may be constructed out of any material suitable for in a deepwater environment. Examples of suitable materials include steel, glass reinforced plastic, and various composite materials. In certain embodiments, shroud 130 may comprise a coating 135. In certain embodiments, coating 135 may comprise a solid glass reinforced plastic, epoxy coatings, specialized paints, and a range of insulating materials. Coating 135 may be structural, semi-structural, or non-structural to achieve a desired shape, geometry, or surface characteristic. In certain embodiments, the shroud 130 may be heavily insulated so that during an unexpected shutdown, the warmed cooling fluid retained in the subsea production cooler module 101 will cool slowly to limit the formation of hydrates in the production fluids.

In certain embodiments, the thickness of coating 135 may be determined by its desired properties. In certain embodiments, the coating may be from about 0.005 inches thick to 0.020 inches thick. In other embodiments, the coating may be from about from 0.1 inches thick to 0.4 inches thick. In other embodiments, the coating may be from 0.02 inches thick to 0.05 inches thick.

In certain embodiments shroud 130 may be sized to envelope the coiled tubing 120, with a clearance gap so it does not contact coiled tubing 120, which may require the shroud internal dimensions and shape exceed that of coiled tubing 120. In certain embodiments, shroud 130 may be cylindrical with a diameter of between 3 feet and 15 feet and/or a length of between 10 feet to about 100 feet.

In certain embodiments, shroud 130 may comprise an inlet 131 and an outlet 132. Inlet 131 may be located at the bottom of shroud 130 and outlet 132 may be located near the top of shroud 130. In certain embodiments, inlet 131 may have a cross sectional area of from 10 square feet to 100 square feet. In other embodiments, inlet 131 may have a cross sectional area of from about 20 square feet to 50 square feet. In certain embodiments, outlet 132 may be a single opening with a cross sectional area of from about 0.25 square feet to 20 square feet or multiple openings having similar aggregate cross sectional area. In certain embodiments, sea water or other cooling fluids may flow into shroud 130 via inlet 131 and flow out of shroud 130 via outlet 132.

In certain embodiments, subsea production cooler module 101 may further comprise a control valve 140. In certain embodiments, control valve 140 may regulate the flow of the sea water or other cooling fluid through outlet 132 of shroud 130. In certain embodiments, the flow of sea water through shroud 130 may be as low as 50 gallons per minute to as large as 3000 gallons per minute. The setting of control valve 140 may be adjusted to maintain a given production fluid outlet temperature set point based upon production flow rate and inlet temperature. By manipulating control valve 140, an operator, or a control system, can monitor and adjust the amount of heat being removed from the production stream to produce a desirable outlet temperature as well as purposefully halt the main process of heat transfer and retain the heat of the production stream in the cooler in the event of an unexpected flow shutdown.

In certain embodiments, shroud 130 may further comprise one or more support structures 135. Support structure 139 may be located on a base 136 of shroud 130. In certain embodiments, support structure 139 may be porous to allow the flow of cooling fluid into shroud 130, thus forming the shroud inlet 131. Support structure 139 may be integral and an extension of the material used to construct the shroud 130, and may comprise structural beams or other components that support shroud 130. Support structure 139 may be a separate component than shroud 130, and may be permanently attached to shroud 130. Support structure 139 may be constructed of different materials than shroud 130 and may be designed to provide a relatively heavy base to aid installation and may provide high structural integrity at the base of the shroud to ensure its robustness.

In certain embodiments, shroud 130 may be removable. In certain embodiments, shroud 130 may comprise one or more lift points 137 whose position can be adjusted so that the net lift force vector passes through the center of gravity. In certain embodiments, shroud 130 may be lifted upward from its normal position around core 110 and coiled tubing 120. Once clear of the core 110, a robotic submarine (a Remotely Operated Vehicle, or ROV) could inspect and/or test properties of any external fouling present, and cleaning could be performed, either with tools attached to the ROV, or by a dedicated semi-automated walking device similar to a swimming pool cleaner moving on or near the coils.

In certain embodiments, shroud 130 may comprise a conical roof 138. The conical roof 138 may help to deflect falling sediment from entering the subsea production cooler module 101 during non-operational periods.

The basic design of subsea production cooler module 101 creates a large amount of pipe surface that is exposed to cold sea water or other cooling fluid. In certain embodiments, by encasing the coiled tubing 120 in a shroud 130, the velocity at which the natural convection of the cooling fluid flows around the coiled tubing 120 may be increased, enhancing the heat transfer abilities of the subsea production cooler module 101. In certain embodiments, by positing the gas lift injector 190 above the coiled tubing 120 and injecting gas through the gas lift injection valve while the subsea cooler production module 101 is in operation, the velocity of the cooling fluids flowing around the coiled tubing 120 may be further increased.

During unplanned shutdowns, control valve 140 may be completely closed to trap warm sea water or other cooling fluid within subsea production cooler module 101. The warmest cooling fluid may rise to the top of subsea production cooler module 101, potentially exposing the bottom portion of coiled tubing 120 to excessive cooling. In order to prevent the bottom coils from excessive cooling, subsea production cooler module 101 may comprise an electric heater or a thermal reservoir 150, located below the lowest portion of the coiled tubing 120.

In certain embodiments, thermal reservoir 150 may comprise a storage tank 151, an inlet 152, an outlet 153, a valve 154, and coiled tubing 155. Storage tank 151 may be capable of storing several hundred gallons of warmed cooling fluid. In certain embodiments, storage tank 151 may be disposed within a hollow center of core 110. In certain embodiments, storage tank 151 may be disposed in a cavity defined by coiled tubing 120. In certain embodiments, storage tank 151 may be disposed in a cavity defined by coiled tubing 155. In certain embodiments, coiled tubing 155 may be coiled around a bottom portion of core 110. Valve 154 may regulate the flow of warmed cooling fluid through inlet 152, outlet 153, and coils 155. In certain embodiments, coiled tubing 155 may have the same material construction of coiled tubing 120.

During shutdowns, valve 154 may be opened to allow the warmed cooling fluid to flow through inlet 152, outlet 153, and coils 155. This warmed cooling fluid may heat the cooling fluid in the bottom portion of the subsea production cooler module 101 and allow for the heating of the bottom portion of coiled tubing 120. In certain embodiments, storage tank 151 may comprise an expansion chamber 156 to allow for the warmed cooling fluid to swell and shrink, depending on its temperature. During normal operation of the subsea production cooler module 101, the warmed cooling fluid in storage tank 151 may be warmed to the outlet temperature of the production fluid flowing through vertical discharge line 128 by passage of the discharge line through the storage tank 151, allowing the contents to be heated by the production fluid until their respective temperatures are nearly the same.

In certain embodiments, subsea production module 101 may comprise a running tool. The running tool may be a permanently-mounted or removable running tool. In certain embodiments, the running tool may be attached to shroud 130. The running tool may allow for a true vertical removal path for shroud 130 so that interference with the core 110 and coiled tubing 120 is minimized. In certain embodiments, one or more centralizers may ensure that the shroud does not contact coiled tubing 120 during removal or operation.

Figure 2:
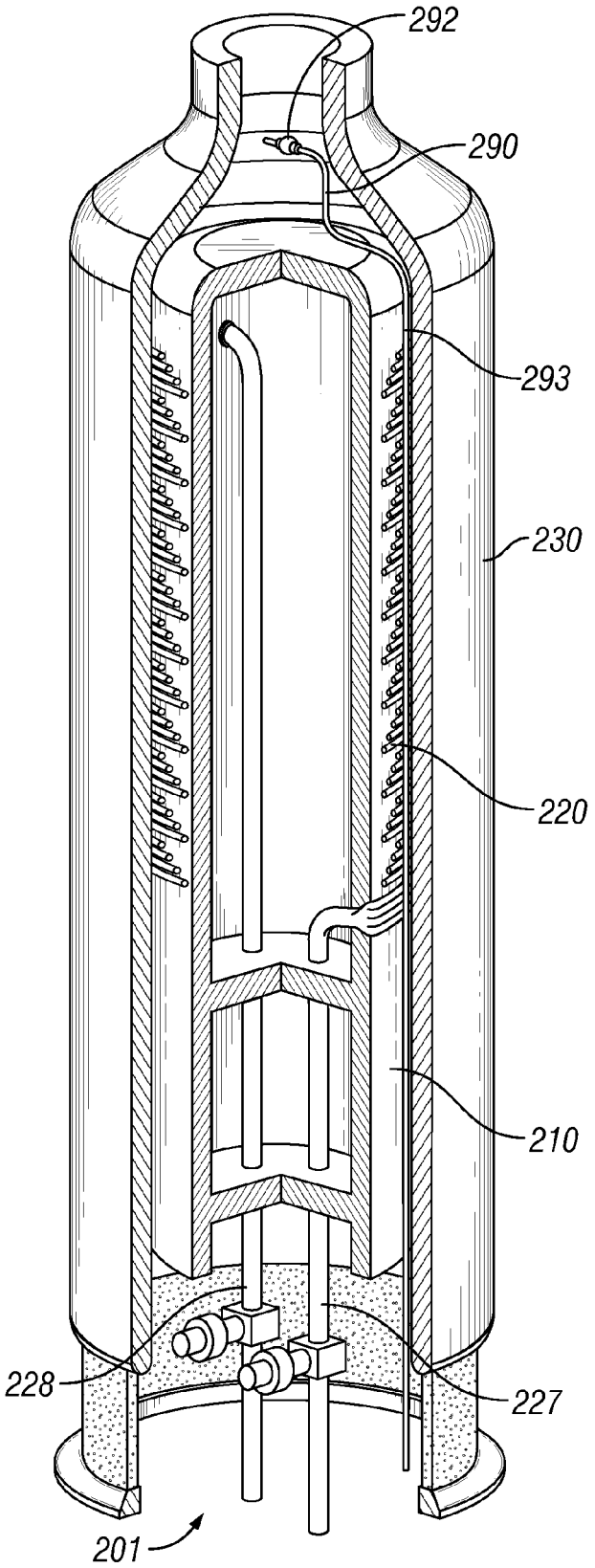
FIG. 2 is an illustration of a subsea production cooler module in accordance with certain embodiments of the present disclosure.

Referring now to FIG. 2, FIG. 2 illustrates a partial solid model rendering of a subsea production cooler module 201 in accordance with certain embodiments of the present disclosure. Similar to subsea production cooler module 101 illustrated in FIG. 1, subsea production cooler module 201 may comprise a core 210, coiled tubing 220, a shroud 230, and/or gas lift injector 290 with gas lift injection valve 292 and feed line 293. In FIG. 2, coiled tubing 220 is shown to comprise four individual coils of tubing. Hot production fluid line 227 and vertical discharge line 228 are shown to be within a hollow center of core 210.

Figure 3:
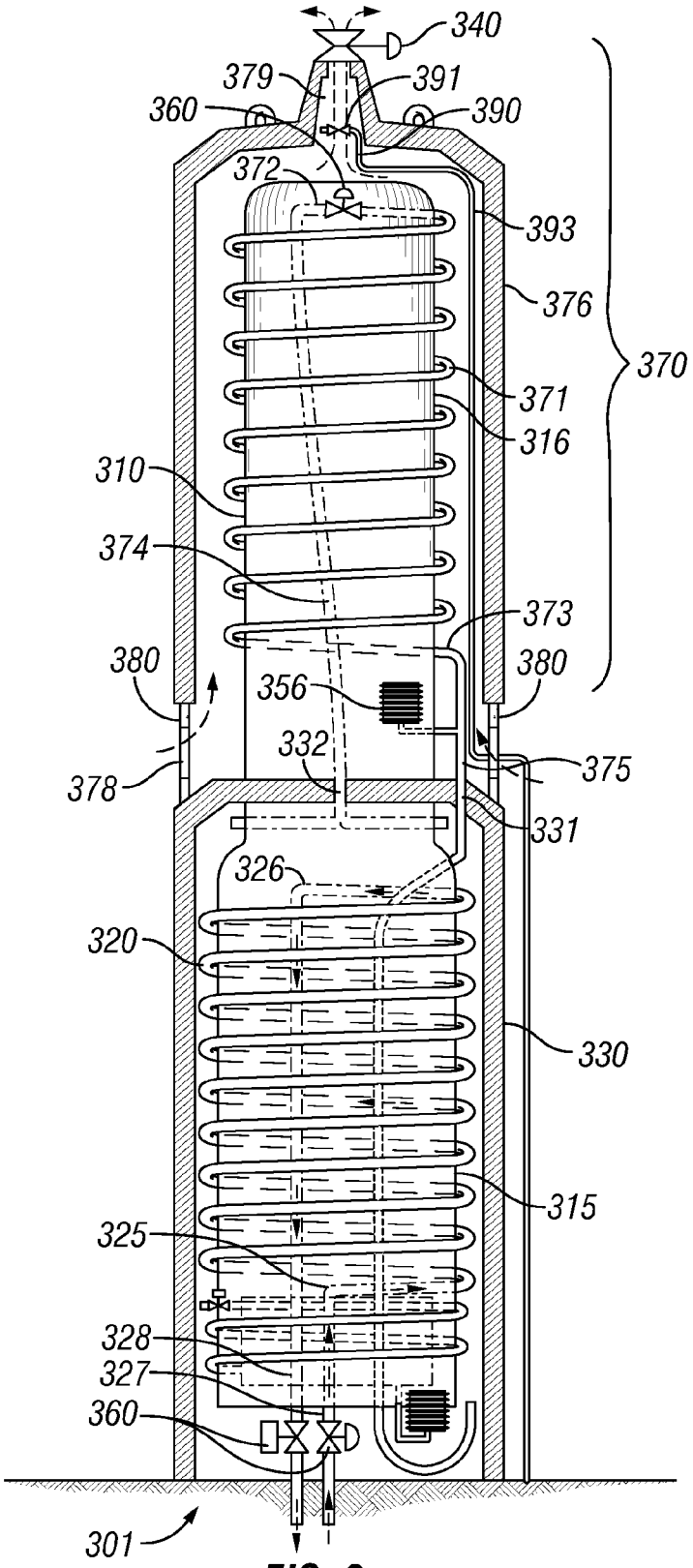
FIG. 3 is an illustration of a subsea production cooler module in accordance with certain embodiments of the present disclosure.

Referring now to FIG. 3, FIG. 3 illustrates an alternative concept of a subsea production cooler module 301. While in certain embodiments subsea production cooler module 301 may share each of the same features of subsea production cooler modules 101 and 201, for example, subsea production cooler module 301 may comprise a core 310, coiled tubing 320 comprising an inlet 325 connected to a hot production fluid line 327 and outlet 326 connected to a vertical discharge line 328, one or more valves 360, shroud 330 with an inlet 331 and an outlet 332, gas lift injector 390 with gas lift injection valve 391 and feed line 393, and a control valve 340, several key differences between subsea production cooler module 301 and subsea production cooler modules 101 may exist.

One difference between subsea production module 301 and subsea production module 101, is that while the bottom of shroud 130 of subsea production cooler module 101 may be open to seawater, the bottom portion of shroud 330 is not open to seawater. Rather, shroud 330 completely encases a bottom portion 315 of core 310 isolating it from contact with the seawater. Instead, inlets 331 and outlet 332 of shroud 330 may be fluidly connected to a cooling fluid chiller 370.

In certain embodiments, cooling fluid chiller 370 may surround a top portion 316 of core 310. In certain embodiments, cooling fluid chiller 370 may comprise chiller tubing 371 and chiller shroud 376.

In certain embodiments, chiller tubing 371 may comprise the same features of coiled tubing 120. In certain embodiments, chiller tubing 371 may be coiled around a top portion 316 of core 310. In certain embodiments, chiller tubing 371 may comprise an inlet 372 and an outlet 373. In certain embodiments, inlet 372 may be connected to outlet 332 of shroud 330 by means of a warm coolant line 374. In certain embodiments, outlet 373 may be connected to inlet 331 of shroud 330 by means of a cold coolant line 375. In certain embodiments, a coolant expansion chamber 356 may be connected to the cold coolant line 375.

In certain embodiments, chiller shroud 376 may be disposed around top portion 316 of core 310 and chiller tubing 371. In certain embodiments, chiller shroud 376 may share similar characteristics of shroud 130. In certain embodiments, valve 340 may regulate the flow of sea water through inlet 378 and outlet 379 of chiller shroud 376.

In certain embodiments, chiller shroud 376 may further comprise one or more support structures 380. Support structure 380 may be located on a base 381 of chiller shroud 376 and attach chiller shroud 376 to shroud 330. In certain embodiments, support structure 380 may be porous to allow the flow of cooling fluid into chiller shroud 376, thus forming the inlet 378. Support structure 380 may share common characteristics with support structures 135.

During operation, warmed coolant from outlet 332 of shroud 330 may flow upward into chiller tubing 371 of cooling fluid chiller 370. The warmed coolant may be cooled by surrounding sea water flowing into the chiller shroud 376 through inlet 378. As the warmed coolant is cooled, it may flow downward through chiller tubing 371 where it is further cooled by seawater flowing upward through chiller shroud 376. The cooled coolant may then exit cooling fluid chiller 370 via cold coolant line 375 and re-enter the bottom of shroud 330. One or more valves 360 may regulate the flow of cooling fluid through the warm coolant line 374 and the cold coolant line 375 and one or more valves 340 may regulate the flow of sea water through inlet 378 and outlet 379.

Figure 4:
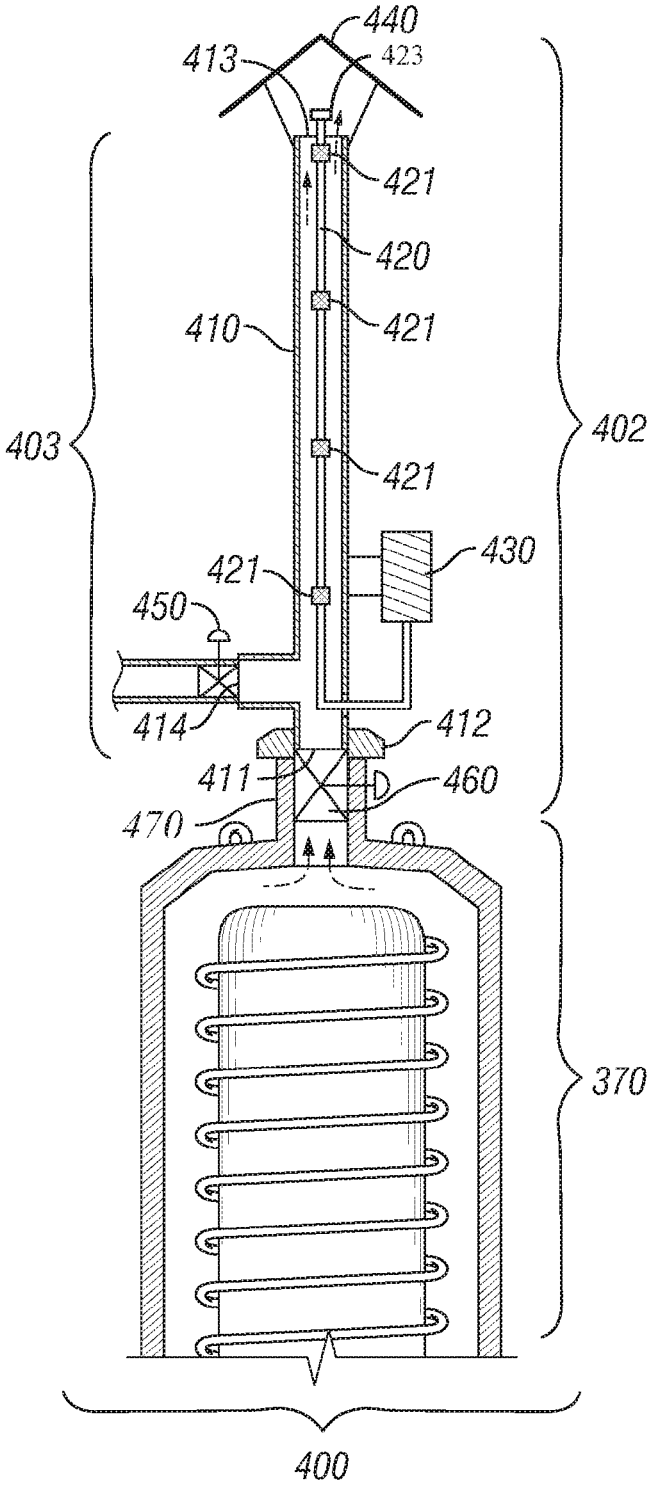
FIG. 4 is an illustration of a subsea production cooler module in accordance with certain embodiments of the present disclosure.

Referring now to FIG. 4, FIG. 4 illustrates a subsea production cooler module 400 comprising a passive cooler module 401 and a gas lift module 402. In certain embodiments, passive cooler module 401 may comprise any combination of characteristics discussed above with respect to subsea cooler module 101, 201, and 301. In certain embodiments, passive cooler module 401 may comprise any embodiments of the subsea production cooler modules discussed in example of such a cooler is described in U.S. Patent Application 61/831,880, the entirety of which is hereby incorporated by reference. In certain embodiments, a gas lift module 402 may be installed on top of passive cooler module 401.

In certain embodiments gas lift module 402 may comprise a gas lift injector 403. In certain embodiments, gas lift injector may comprise a stand pipe 410 and gas line 420.

In certain embodiments, stand pipe 410 may comprise any type of stand pipe. In certain embodiments, stand pipe 410 may be a hollow pipe defining a cavity. In certain embodiments, stand pipe 410 may have a length of from 1 feet to 100 feet tall. In certain embodiments, stand pipe 410 may be constructed out of any material suitable for use in a subsea environment. In certain embodiments, stand pipe 410 may be constructed of carbon steel, stainless steel, titanium, nickel alloys, and composite materials. In certain embodiments, stand pipe 410 may comprise an inlet 411, gas-line inlet 412, outlet 413, and a by-pass outlet 414.

In certain embodiments, stand pipe 410 may comprise an inner coating (not illustrated in FIG. 4) and/or an outer coating (not illustrated in FIG. 4). In certain embodiments, inner coating may comprise ceramic enamel or a diamond-like coating. In certain embodiments, the inner coating may be from 2 to 30 microns thick. In other embodiments, the inner coating may be from 5 to 10 microns thick. In certain embodiments, outer coating may comprise ceramic enamel, ethylene copolymer such as Halar, a thermoset polymer, a diamond-like coating, or a phenolic coating. In certain embodiments, the outer coating may be from 2 microns thick to 400 microns thick. In other embodiments, the outer coating may be from 10 microns thick to 50 microns thick.

In certain embodiments, a gas line 420 may be disposed within stand pipe 410. In certain embodiments, gas line 420 may comprise one or more injection valves 421 and an end cap 423. In certain embodiments, gas line 420 may comprise 4, 5, 6, 7, 8, 9, 10, or more injection valves. In certain embodiments, the one or more injection valves 421 may be disposed an equal distance apart from each other within stand pipe 410. In certain embodiments, gas line 420 may pass through a core section of a passive cooler.

In certain embodiments, gas line 420 may permit the injection of a gas into stand pipe 410. In certain embodiments, the gas may be air, nitrogen, or carbon dioxide. In other embodiments, the gas may be any gaseous product that is benign to the environment.

In certain embodiments, gas line 420 may enter stand pipe 410 through gas-line inlet 412. In certain embodiments, gas line 420 may be connected to hot stab 430. In certain embodiments, hot stab 430 may allow for the connection of a gas feed line (not illustrated) to gas line 420.

In certain embodiments, gas lift module 402 may further comprise attachment mechanism 470 and subsea cooler valve 460. In certain embodiments, attachment mechanism 470 may be capable of securing gas lift module 402 on top of passive cooler module 401. In certain embodiments, attachment mechanism 470 may be operated by an ROV to allow the installation and/or removal of gas lift module 402 from the top of passive cooler module 401. When gas lift module 402 is installed on top of passive cooler module 401, subsea cooler valve 460 may permit the flow of seawater from through passive cooler module 401 to through gas lift module 402.

In certain embodiments, gas lift module 402 may further comprise debris hat 440. In certain embodiments, debris hat 440 may be a conical roof. In certain embodiments, debris hat 440 may help to deflect falling sediment from entering the gas lift module 402 during non-operational periods.

In certain embodiments, gas lift module 402 may further comprise by-pass valve 450. In certain embodiments, by-pass valve may be opened to allow sea water to flow through outlet 414 of the gas lift module thereby by-passing the gas lift.

In certain embodiments, the use of gas lift module 402 may provide gas lift to subsea cooler production module 400. The gas lift may function similarly to gas lift in wells. Air injected into the gas lift module 402 may act to increase the upward flow of the cooling water via both a density difference and an increase in gas volume as it rises offering acceleration.

Figure 5:
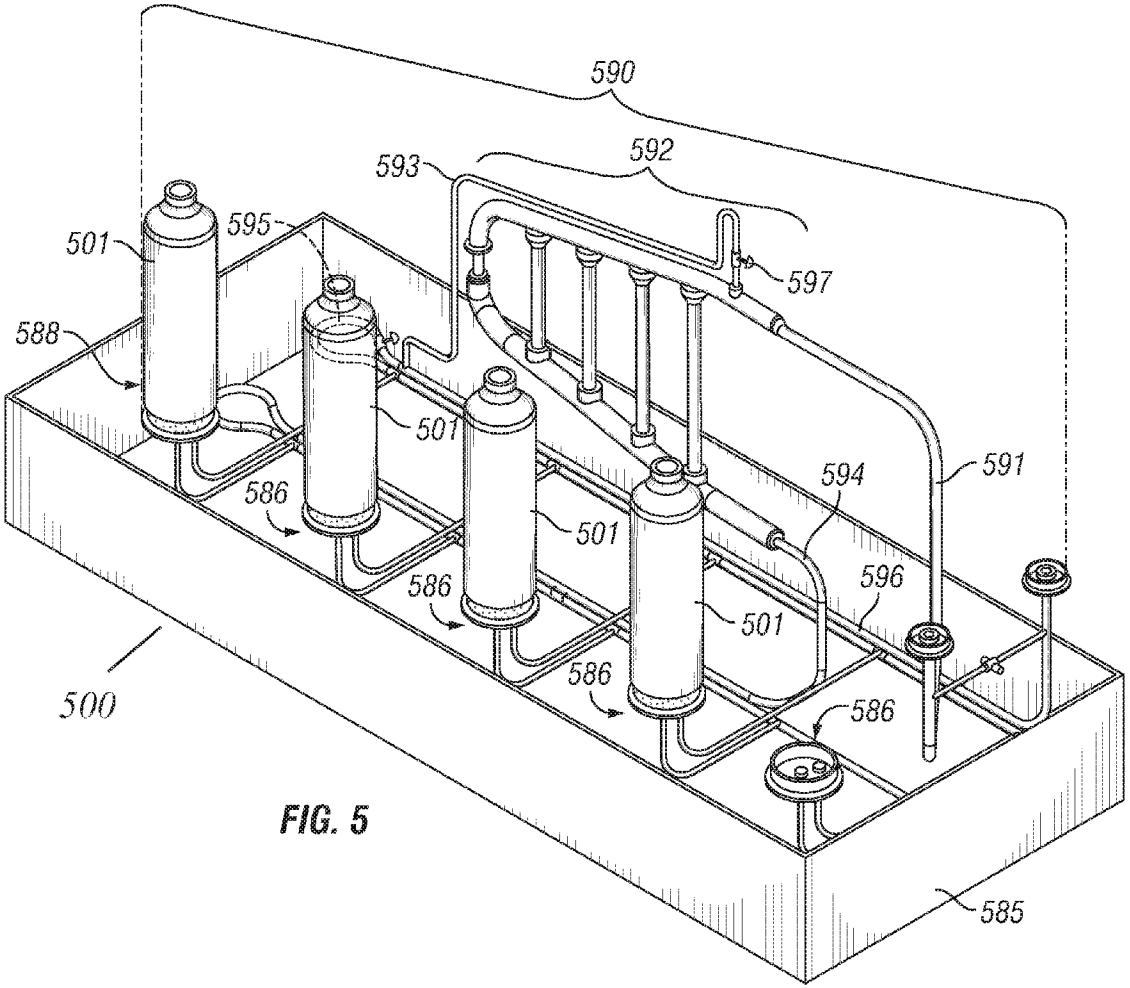
FIG. 5 is an illustration of a subsea production cooler in accordance with certain embodiments of the present disclosure.

Referring now to FIG. 5, FIG. 5 illustrates subsea production cooler 500 comprising subsea production cooler modules 501, base 585, and piping system 590.

Subsea production cooler modules 501 may comprise any of the components of subsea production cooler modules discussed previously. In certain embodiments (not illustrated in FIG. 5), each one of subsea production cooler modules 501 may be connected to a gas lift module, as illustrated in FIG. 4.

Base 585 may be designed to contain piping system 590 and to provide one or more sites 586 to install the one or more subsea production cooler modules 501. FIG. 5 illustrates a subsea production cooler comprising 4 subsea production cooler modules 501 installed on base 585 with 5 sites 586.

In certain embodiments base 585 may be constructed mainly of steel, similarly to other subsea equipment such as piping manifold, subsea pumping systems, etc. The base 585 may be (when viewed from above) roughly 40 feet wide, 100 feet long, and 20 feet tall. The base 585 may be set on the seafloor itself using a mudmat. The base 585 may be set onto one or more subsea pilings designed to resist not only the weight of the base, but also to predictably resist any moment created by the rather tall subsea production cooler modules 501, or by uneven or imbalanced loading created by various combinations of filled or empty sites 586. In certain embodiments sites 586 may comprise a multibore connector. In certain embodiments, sites 586 may support the forces and moments generated by the presence of subsea production cooler module 501 via the multibore connector, or support for the subsea production cooler may be supported by contact of one or more structural members of the subsea production cooler resting on the base 585. In certain embodiments, sites 586 may support the subsea production cooler module 501 by a combination of the multibore connector and separate structural members.

Piping system 590 may comprise a hot multiphase production line 591, a separator 592, a hot gas line 593, a hot liquid line 594, a cooled liquid line 595, and a cooled multiphase production line 596. In certain embodiments, separator 592 may comprise an arrangement of piping components arranged so as to slow the multiphase mixture and allow gravity separation of liquids and gas, while simultaneously providing flowpaths for both liquid-rich streams and gas-rich streams. Separator 592 may separate the fluid from hot multiphase production line 591 into hot gas line 593 and hot liquid line 594. At typical operating condition, when entering separator 592, the temperature of the fluid in hot multiphase production line 591 may be from 300° F. to 450° F., the pressure may be in the range of from 1500 psia to 7000 psia, and the gas volume fraction may be in the range of from about 0% to about 80%. The particular operating conditions are dependent on the producing wells and the manner in which the system is operated, and can vary considerably, so these parameters are intended only to illustrate, not to limit the operational envelope of the system being described.

When exiting the separator, the fluid in hot liquid line 594 may be mostly liquid with a minor amount of gas. In certain embodiments, the fluid in hot liquid line 594 may have a gas volume fraction of from about 0% to about 10% at very nearly the same pressure and temperature of the fluid in hot multiphase production line 591. In certain embodiments, the fluid in hot gas line 593 may be mostly gas with a minor amount of liquid. In certain embodiments, the fluid in hot gas line 593 may have a gas volume from of from 90% to about 100% at very nearly the same pressure and temperature of the fluid in hot multiphase production line 591.

The flowrate of fluid in hot gas line 593 may controlled by flow control valve 597, that may simply match, or nearly match, the pressure drop created by various piping and subsea production cooler modules 501. Further, in certain embodiments, manipulation of the temperature of fluid in cooled multiphase production line 596 in relation to the temperature of the fluid in cooled liquid line 595 may be implemented by flow control valve 597. In certain embodiments, this control may be utilized to ensure that a certain thermal mass flowrate exists in hot gas line 593, so that in mixing with fluid in cool liquid 595, a certain higher temperature is maintained in cooled multiphase production line 596.

The fluid in hot liquid line 594 may flow into a single subsea production cooler module 501 or multiple subsea production cooler modules 501 arranged in series or in parallel. Cooled liquid line 595 may be a single stream flowing from a subsea product production cooler, or multiple streams flowing from multiple coolers combined. Fluid from cooled liquid line 595 may be combined with the fluid in hot gas line 593 to form the cooled multiphase production line 596. The fluid in cooled multiphase production line 596 may be nearly the same gas volume fraction as that in hot multiphase production line 591, or by effect of the cooling have attained a gas volume fraction of zero. The temperature of fluid in cooled multiphase production line 596 may be between 150° F. and 300° F. The pressure of fluid in cooled multiphase production line 596 may be near to, but somewhat less than the pressure in hot multiphase production line 591, or it may be considerably lower due to pressure drop in separator 592 and subsea production cooler modules 501.

In certain embodiments, the subsea production coolers discussed herein may have a wide range of operating conditions. In certain embodiments, an operator or a control system can monitor and adjust the amount of heat being removed to produce a desirable outlet temperature as well as purposefully halt the main process of heat transfer and retain the heat of the production in the cooler in the event of an unexpected flow shutdown. In certain embodiments, the subsea production coolers discussed herein are capable of cooling production streams utilizing natural convection and do not require the pumping of cooling fluids.

While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A subsea production cooler comprising:

a subsea production cooler module; wherein the subsea production cooler module comprises:

a coiled tubing, wherein the coiled tubing comprises an inlet and an outlet; and a gas lift injector, wherein the gas lift injector is positioned above the coiled tubing;

a base; and a piping system, wherein the piping system comprises a separator comprising a hot production line, a hot liquid line, and a hot gas line comprising a flow control valve.

2. The subsea production cooler of claim 1, wherein the subsea production cooler comprises multiple subsea production cooler modules arranged in series.

3. The subsea production cooler of claim 1, wherein the subsea production cooler comprises multiple subsea production cooler modules arranged in parallel.

4. A method of cooling a subsea production stream, the method comprising:

providing a subsea production stream and cooling the subsea production stream with a subsea production cooler module, wherein the subsea production cooler module comprises:

a coiled tubing and a gas lift injector, wherein the gas lift injector is positioned above the coiled tubing, wherein cooling the subsea production stream with the subsea production cooler module comprises flowing the production stream upward through the coiled tubing.

5. The method of claim 4, wherein cooling the subsea production stream with the subsea production cooler module comprises:

separating the subsea production stream into a hot liquid stream and a hot gas stream;

cooling the hot liquid stream with the subsea production cooler module thereby forming a cooled liquid stream; and combining the cooled liquid stream and the hot gas stream to form a cooled subsea production stream.

6. The method of claim 4, further comprising injecting gas through the gas lift injector valve while cooling the subsea production stream.

7. The method of claim 6, wherein cooling the subsea production stream with a subsea production cooler is performed without pumping the subsea production stream or the cooling fluid.

* * * * *